United States Patent [19]

Hori

[11] 4,139,313

[45] Feb. 13, 1979

[54] WRITING ELEMENT FOR USE IN BALL POINT PEN

[76] Inventor: Jiro Hori, 545 Tenno-cho, Kure-shi, Hiroshima-ken, Japan

[21] Appl. No.: 747,209

[22] Filed: Dec. 3, 1976

[30] Foreign Application Priority Data

Dec. 10, 1975 [JP] Japan ..... 50-165725[U]

[51] Int. Cl.[2] ..... B43K 7/10

[52] U.S. Cl. ..... 401/216

[58] Field of Search ..... 401/209-216

[56] References Cited

U.S. PATENT DOCUMENTS 3,945,735 3/1976 Nakashiki et al. ..... 401/216

FOREIGN PATENT DOCUMENTS 1002407 4/1951 France ..... 401/216

340427 9/1959 Switzerland ..... 401/216

1134034 6/1968 United Kingdom ..... 401/216

*Primary Examiner*—Stephen C. Pellegrino

*Attorney, Agent, or Firm*—Bacon & Thomas

[57] ABSTRACT

Disclosed is a writing element for use in a ball point pen comprising a ball seat member which supports a ball on a ball seat disposed at its tip end and an outer sleeve which is fitted over the ball seat member to keep the ball on the ball seat. Said outer sleeve is slidably fitted to the ball seat member so as to be frictionally engaged with the ball seat member to be slid rearwardly by the extent to which the ball seat has been worn due to the writing pressure acting on the sleeve.

12 Claims, 15 Drawing Figures

WRITING ELEMENT FOR USE IN BALL POINT PEN

This invention relates to a writing element for use in a ball point pen adapted for use with low viscosity aqueous ink.

A known ball point pen comprises a ball seat member which supports a writing ball on its tip end and an outer sleeve which is fixedly fitted over the ball seat member to keep the writing ball on the tip end of the ball seat member by a crimped terminal end. In this structure, the outer sleeve is made immovable relative to the ball seat member, causing said tip end of the ball seat member, i.e., the ball seat to be worn out due to a long use, resulting in the loose fitting of the ball. Consequently, the low viscosity aqueous ink excessively flows out through relatively wide gaps created as a result of the loose fitting of the ball and falls off in noticeable drops as is generally known.

The object of this invention is, therefore, to provide a writing element for use in ball point pens in which the wear of the ball seat is compensated by the sliding of the outer sleeve relative to the ball seat member, thereby preventing the low viscosity aqueous ink from flowing out due to the loose fitting of the ball.

A writing element for use in ball point pen according to the present invention is provided with an outer sleeve frictionally and slidably fitted over a ball seat member to keep a ball on a ball seat of the ball seat member. The frictional engagement of the ball seat member with the outer sleeve is so provided that the sleeve is usually kept on the ball seat member by the friction between the sleeve and the ball seat member, but that, for example, when the sleeve has an external force applied thereto to a degree as of a writing pressure, it is slid along the ball seat member by the external force. Consequently, when the ball seat of the ball seat member is worn due to long use, the outer sleeve is pushed up by the writing pressure along the ball seat member by the extent to which the ball seat has been worn, keeping the ball in its normal position.

A capillary passage leading the ink to the ball can be constructed of a slit-type groove formed in the outer sleeve, or a slit-type groove formed in the ball seat member, or a gap between the outer sleeve and the ball seat member. In case of the last-mentioned type of capillary passage, the ball seat member preferably has a cross section inscribed in that of the outer sleeve. For example, if the outer sleeve is circular in cross section, the ball seat member may have a polygonal or elliptic cross-section, and if the ball seat member has a circular cross section, the outer sleeve may have a polygonal or elliptic cross section.

The ball seat member is preferably formed of elastic materials. This type of ball seat member functions to mitigate a force acting on the ball even in case of the outer sleeve having been strongly pressed. Further, when the outer sleeve is forcibly pressed several times in its longitudinal direction, the ball seat member is expanded and contracted in the outer sleeve to lead out the ink by such pumping operation.

Preferably, the writing element is provided with a holding casing which is slidably fitted around the outer circumference of the outer sleeve and fixed, in a position rearwardly spaced from the rear end of the outer sleeve, on the ball seat member.

An embodiment of the invention will now be described in detail by reference to the appended drawings, wherein:

FIG. 1 is a longitudinal cross sectional view of a ball point pen having a writing element according to an embodiment of the present invention;

FIGS. 2 and 3 are cross sectional views as taken along line 2—2, and 3—3 of FIG. 1, respectively;

Figure 10:
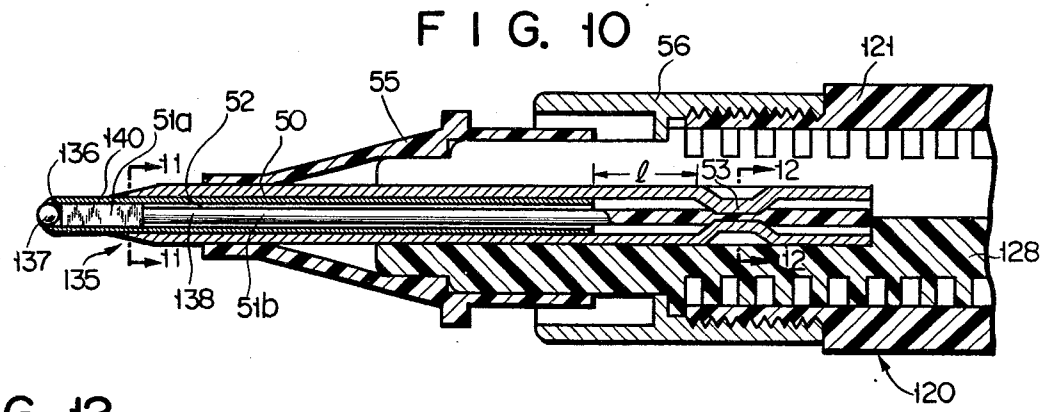
FIG. 10 is a longitudinal cross sectional view of the ball point pen having the writing element according to still another embodiment of the invention.
Figure 14:
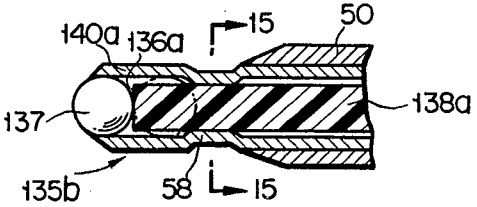
Figure 15:
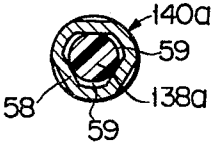
Figure 12:
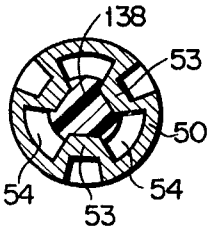
Figure 11:
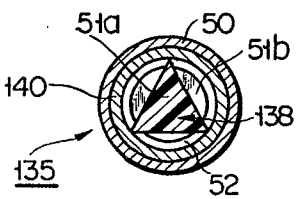
Figure 13:
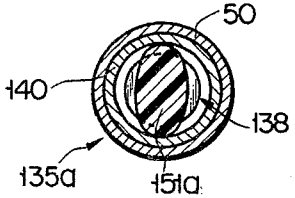

FIGS. 11 and 12 are cross sectional views as taken along lines 11—11 and 12—12 of FIG. 10;

FIG. 13 is a cross sectional view same as FIG. 11, showing a modification of the writing element in FIG. 10;

FIG. 14 is a longitudinal cross sectional view showing another modification of the writing element in FIG. 10; and FIG. 15 is a cross sectional view as taken along line 15—15 of FIG. 14.

Figures 1, 2, 3, 4, 5, 6, 7, 8:
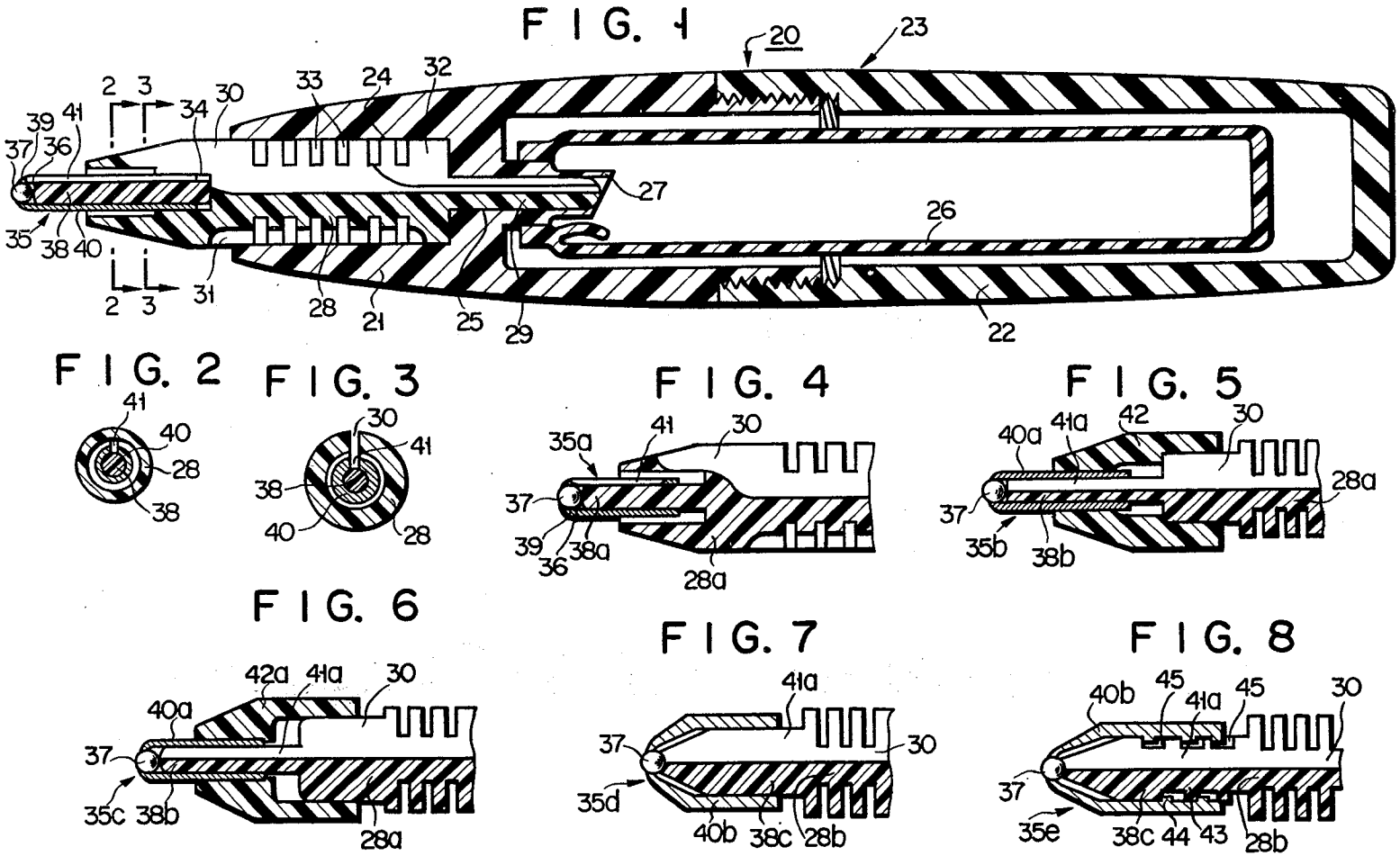
FIGS. 4 to 9 are longitudinal cross sectional views showing the writing element according to other embodiments of the present invention.

In FIGS. 1 to 3, a ball point pen 20 includes a pen barrel 23 made of rigid plastics, formed of a front part 21 and a rear part 22 threadably connected with each other. At the tip end of the front part 21 is formed a large-diameter recess 24, which is connected to a reduced hole 25 communicating with the interior of a barrel 23. The reduced hole 25 is formed in a projection 27 pierced into an ink cartridge 26. The large-diameter recess 24 is fitted with an ink feed 28 and a reduced rod portion 29 of the ink feed 28 is inserted into the reduced hole 25. The ink feed 28 comprises a narrow-width longitudinal capillary groove 30 for inducting aqueous ink from the ink cartridge 26 and two comparatively broad-width air-inlet grooves 31 and 32 for admitting air to the ink cartridge 26. Around the outer circumference of the ink-feed 28 are provided, in a generally known manner, a plurality of annular grooves 33 constituting a reservoir to receive an excess amount of ink.

At the foreend of the ink feed 28 is a cylindrical elongate recess 34 into which is inserted a writing element 35 of this invention. The writing element 35 comprises a rod-type ball seat member 38 rotatably supporting a rigid ball 37 on a ball seat 36, i.e., the fore-end portion of the writing element, and a sleeve 40 which is complementarily and slidably fitted over the outer circumference of the ball seat member to keep the ball 37 on the seat 36 with the crimped or deformed fore-end portion 39 of the sleeve 40. The ball seat member 38 and the sleeve 40 are moved longitudinally along the ball seat member 38 when the sleeve receives a greater force than prescribed, for example, an external force about as strong as the pressure with which the pen is pressed during writing. Normally, however, the member 38 and sleeve 40 are frictionally engaged with each other so as to permit the sleeve to be kept in place without being slidingly drawn off from the member 38. The ball seat member 38 is preferably made of a suitable wear-resistant material such as nylon impregnated with molybdenum disulfide or polyacetal. The sleeve 40 is preferably made of suitable metal or hard plastics materials. The writing element 35 having the foregoing construction is inserted into the recess 34 of the ink feed 28, and the ball seat member 38 of the element is fixed at its rear-end by some adhesive agents to the bottom of the recess 34.

The rear-end of the sleeve 40 is separated from the bottom of recess 34 so as to compensate, as later described, the wear of the ball seat member 38. Further, the sleeve 40 is formed with a slit-type longitudinal capillary groove 41 for inducting the ink from the capillary groove 30 to the ball 37.

When the pen is in use, the low viscosity aqueous ink contained in the ink cartridge 26 is delivered, in a generally known manner, through the capillary grooves 30 and 41 to the ball 37, and drawn out little by little from the gap between the ball 37 and the crimped fore-end portion 39. Normally, the sleeve 40 is frictionally engaged with the ball seat member 38, and will not droped off by its own weight. When, after a period of use, the ball seat 36 of the ball seat member has been worn, the ball 37 can retreat by the extent to which the ball seat has been worn to cause creation of an excessive gap. When, in this condition, the ball point pen 20 is used, the foremost end 39 of the sleeve 40 is caused to abut against the paper surface and the sleeve 40 is pushed up by reaction, along the ball seat member 38 to an extent corresponding to the worn amount, and thus the frictional wear of the ball seat 36 is compensated to keep the ball 37 in its normal condition.

In the above-mentioned embodiment, the rear end of the ball seat member 38 is fixed to the ink feed 28, in place of which, however, the sleeve 40 may be frictionally engaged with the inner wall of the recess 34 with the member 38 kept unfixed.

FIGS. 4 to 15 show other embodiments of this invention, in which the same parts and sections as those of the first embodiment are designated by the same numerals and marks, and the detailed descriptions are omitted.

The writing element 35*a* shown in FIG. 4 has a ball seat rod 38*a* formed integrally with the ink feed 28*a*. The ball seat rod 38*a* and the ink feed 28*a* are made of the same material as that of the ball seat rod 38 in the aforesaid embodiment.

In the aforesaid embodiments, the capillary groove for inducting ink from the ink feed to the ball is formed in the sleeve. This groove, as shown in the embodiments as hereinafter described, may be formed in the ball seat member.

In FIG. 5, the ball seat rod 38*b* is formed integrally with the ink feed 28*a*, and has a longitudinal capillary groove 41*a* continuously connected to the capillary groove 30 of the ink feed. The outer sleeve 40*a* has no groove. A supporting cap 42 is tightly provided at the fore-end of the ink feed 28*a*. The outer sleeve 40*a* is made slidable not only to the ball seat rod 38*b* but also to the supporting cap 42. The supporting cap 42 protects the ink feed 28*a* and the outer sleeve 40*a* and also prevents the sleeve and the ball seat rod 38*b* from being flexed.

In FIG. 6, the outer sleeve 40*a* is fixed to the supporting cap 42*a* which is slidably fitted to the ink feed 28*a*. In this embodiment, the sleeve 40*a* and cap 42*a* are moved together relatively to the ball seat rod 38*b* and the ink feeder 28*a*.

In FIG. 7, the ball seat member 38*c* having a considerably larger diameter than that of the ball 37 is formed integrally with the ink feed 28*b*. The ball 37 is supported at the forward end of the conical portion formed in the forward part of the ball seat member 38*c* and is held in place by the larger-diameter outer sleeve 40*b* slidably fitted to said ball seat member 38*c*.

In FIG. 8, the ball seat member 38*c* has a male screw portion 43 on its outer circumference and the outer sleeve 40*b* has a female screw portion 44 threadedly engaged with said male screw portion 43. A prescribed gap 45 is provided between the back wall of the female screw portion 44 and the front wall of the male screw portion 43. And, the top wall of the male screw portion 43 and the root wall of the female screw portion 44 are frictionally and slidably engaged with each other. Normally, the outer sleeve 40*b* is fixed to the ball seat member 38*c* by the screw engagement of the male screw portion 43 and the female screw portion 44. But, when the forward end of the member 38*c* is worn, the outer sleeve 40*b* is retreated backwardly to an extent corresponding to that worn degree within the width of gap 45.

In the embodiments heretofore described, the outer sleeve having a complementary cross section relative to the ball seat member is frictionally engaged, all around its inner circumferential walls, with the outer circumferential walls of the ball seat member. The capillary passage for inducting the ink upto the ball is formed of the slit-type longitudinal groove formed in the outer sleeve or ball seat member. However, the frictional engagement between the outer sleeve and the ball seat member and the construction of the capillary passage may be of other forms, respectively, as shown in the embodiments as hereinafter described.

Figure 9:
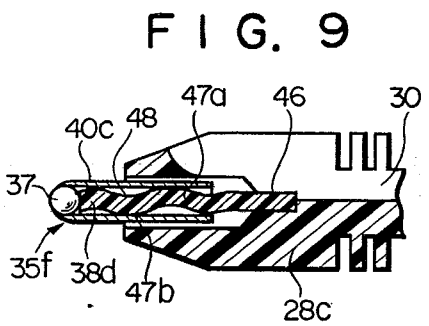

In FIG. 9, the ball seat member 38*d* is formed of a meanderingly bent rod having an outer diameter which is smaller than the inner diameter of the outer sleeve 40*c*. The back end of the ball seat member 38*d* is fixedly fitted to the hole 46 formed in the ink feed 28*c*. The lateral space between the outwardly curved portions 47*a* and 47*b* of both opposed sides of the ball seat member 38*d* is so provided as to be larger, when the member 38*d* is kept in a free condition, than the inner diameter of outer sleeve 40*c*, so that when the outer sleeve 40*c* is forcibly fitted over the member 38*d*, the outwardly curved portions 47*a*, 47*b* are frictionally engaged with the inner wall of the sleeve 40*c*. Further, the ink capillary passage is constituted by the gap 48 between the ball seat member 38*d* and the outer sleeve 40*c*. In this embodiment, the ball seat member 38*d* is made of elastic plastics such as nylon, polyacetal, so that the shock applied onto the ball 37 is absorbed by the ball seat member 38*d*, thus preventing the constituent parts from being damaged. If, when the ink flows badly, the ball 37 is forcibly pressed against the paper several times, the ball seat member 38*d* expands and contracts within the sleeve 40*c*, whereby the ink is brought to the ball 37 by the pumping operation.

In the embodiment as shown in FIG. 10, the writing element 135 comprises a ball 137, a ball seat rod 138, outer sleeve 140, and in addition, a cylindrical shape holding casing 50 slidably fitted over the outer circumference of the outer sleeve 140. The ball seat rod 138 is made of the same material of elastic plastics as in the embodiment of FIG. 9, and comprises a forward portion 51*a* of a polygonal cross section (The figure shows a triangular cross section) inscribed to the inner wall of the outer sleeve 140, and a rear portion 51*b* of a circular cross section having a smaller diameter than the inner diameter of said outer sleeve 140. The edge of the forward portion 51*a* is slidably engaged with the outer sleeve 140 and frictionally keeps the same. Between the side planes of the forward portion 51*a* and the inner wall of the sleeve 140, and between the outer wall of the rear portion 51*b* and the inner wall of the sleeve 140, is formed a gap 52 partially constituting an ink-feeding capillary passage. The holding casing 50 and the ball seat rod 138 are extended further backwardly from the rear end of the outer sleeve 140, and are fixed to each other at a position spaced by a prescribed distance l from the rear end of said sleeve. In this embodiment, the holding casing 50, as shown in FIG. 12, has three projections 53 inwardly formed by pressing process at three positions equiangularly spaced from each other. These projections are carried into the ball seat rod 138 to hold the rod fixedly in place and form the gaps 54 between these projections as ink passages therein.

Around the outer circumference of holding casing 50, is fixedly provided a supporting cap 55 for protecting the writing element 135 as well as for fitting this element to the main body of the ball point pen.

The ball point pen 120 includes an ink feed 128 inserted into the fore part of barrel 121 and held thereat by means of a screw cap 56. The writing element 135 is inserted into the recess 124 located at the fore end of the ink feed 128, and is held by the frictional engagement between the supporting cap 55 and the ink feed 128.

When the pen is in use, the aqueous ink contained in a cartridge (not shown) is delivered, through the capillary groove 130 of the ink feed 128, the gap 57 between the holding casing 50 and the ball seat rod 138, and the said gaps 54, 52 to the ball 137. Responding to the revolution of the ball, the ink is drawn out from the gap between the ball and the fore end 139 of the outer sleeve 140. When the ball seat 136 of the ball seat rod 138 is worn, the outer sleeve 140, as in the aforesaid embodiment, is retreated by the writing pressure thus causing the ball 137 to be kept normally in its optimum condition. Further, when a strong force acts on the tip end of the writing element 35, the ball seat rod 138 will perform buffering and pumping actions as in the embodiment of FIG. 9.

In this embodiment, the outer sleeve 140 is provided around with said holding casing 50 fixed on the ball seat rod 138. Suppose such holding casing 50 is not provided for the writing element, and the ball seat rod 138 and the ball 137 may be drawn from the rear end of the sleeve 140 outwardly thereof when the user directly takes the sleeve 140 disengaged from the main body of ball point pen to press the ball 137 against the paper. But in case of this embodiment, the user has the holding casing 50 and there is no fear of the ball seat rod 138 and the ball 137 being drawn out. Further, in this embodiment, an old writing element 135 can be readily replaced by a new element.

In the embodiment of FIGS. 10 to 12, the forward part 51*a* of the ball seat rod is so formed as to have a polygonal cross section. This polygonal cross section may be of any configuration if it has a smaller cross sectional area than that of the interior of said outer sleeve, and is partially contactable with the inner circumferential wall of said outer sleeve. The engagement between the ball seat rod and the outer sleeve is achieved by the friction between said contacting parts. The ink induction capillary passage is constructed between the ball seat rod and outer sleeve at the non-contact portions therebetween. In FIG. 13, the forward part 151*a* of the ball seat rod 138 has an elliptic section contacting with the inner circumference of the outer sleeve 140. In this case, the forward part 151*a* is frictionally engaged with the outer sleeve 140 at its end portions in the major axial direction.

In the writing element 135*b* shown in FIG. 14, the ball seat rod 138*a* has a circular cross section having a specified diameter smaller than the inner diameter of the outer sleeve 140*a*, and also has a capillary gap 57 between said rod 138*a* and the inner wall of the outer sleeve. On the other hand, the outer sleeve 140*a* has a transformed portion 58 at a position slightly displaced from the ball 137, the transformation of the portion 58 being effected by, for example, pressing process. In case of this embodiment, the transformed portion 58 has a triangular cross section circumscribed to the circular cross section of the ball seat rod 138*a* and the sectional area of the triangular cross section is smaller than that of the ball 137. The outer sleeve 140*a* is slidably engaged with and frictionally kept on the ball seat rod 138*a* at the sides of the sectional triangle of the transformed portion 58. Formed at the non-contact part between the transformed portion 58 and the ball seat rod 138*a* is a capillary gap 59 as shown in FIG. 15.

In this embodiment, the ball seat rod 138*a* has only to be so formed as to have a uniform section and the writing element 135*a* can be readily made. In case the outer sleeve 140*a* is drawn out from the writing element 135*a*, the ball 137*a* is prevented by the transformed part 58 from being loosened off from the outer sleeve 140*a*. In other words, the transformed part 58 serves as a stopper to the ball 137*a*. It is to be noted that the ball 137*a* is supported, when the pen is in use, not by the transformed part 58, but by the ball seat rod 138*a*.

It is apparent that the forms and constructions of outer sleeve and ball seat rod as shown in FIGS. 10 to 15 may be applied not only to writing element having a holding casing but also the writing element with no holding casing.

What is claimed is:

1. A writing element for use in a ball point pen having a body member comprising a ball seat member fixed relative to said body member and having a ball seat on its tip-end, a ball rotatably supported on the ball seat, and an outer sleeve means surrounding said ball and having holding means keeping the ball on the ball seat of the ball seat member, the outer sleeve means being frictionally slidable relative to said body member so that writing pressure enables the outer sleeve means to move backward by the extent to which the ball seat has been abraded.

2. A writing element according to claim 1, wherein at least one part of said ball seat member has a cross section inscribed to that of said outer sleeve means.

3. A writing element according to claim 2, wherein said one part of said ball seat member has a substantially polygonal cross section and said outer sleeve means has a substantially circular cross section.

4. A writing element according to claim 2, wherein said ball seat member has a substantially elliptical cross section and said outer sleeve means has a substantially circular cross section.

5. A writing element according to claim 2, wherein said ball seat member is made of elastic material.

6. A writing element according to claim 1, wherein at least one part of said outer sleeve means has a cross section circumscribed to the ball seat member.

7. A writing element according to claim 6, wherein said one part of the outer sleeve means has a substantially polygonal cross section and the ball seat member has a substantially circular cross section.

8. A writing element according to claim 7, wherein said one part of the outer sleeve means has a smaller cross section than that of the ball and is located at a position spaced by a specified distance rearwardly from the ball.

9. A writing element according to claim 1, which further comprises a holding casing slidably fitted over the outer circumference of the outer sleeve means and fixed to the ball seat member at a specified distance taken rearwardly from the rear end of the outer sleeve means.

10. A writing element according to claim 1, wherein the outer sleeve means has a capillary groove for inducting ink to the ball.

11. A writing element according to claim 1, wherein the ball seat member has a capillary groove for inducting ink to the ball.

12. A writing element according to claim 1, which further comprises an ink feed provided integrally with the ball seat member.

* * * * *